US005255765A

United States Patent [19]

Schrecongost

[11] Patent Number: 5,255,765

[45] Date of Patent: Oct. 26, 1993

[54] REMOVABLE LUGGAGE COVER

[75] Inventor: Deborah Schrecongost, Chicago, Ill.

[73] Assignee: Loonatickle, Inc., Boise, Id.

[21] Appl. No.: 885,518

[22] Filed: May 19, 1992

[51] Int. Cl.[5] ..... A45C 13/30

[52] U.S. Cl. ..... 190/26; 52/5; 150/154

[58] Field of Search ..... 190/25, 26; 150/154; 52/3, 5; 428/98, 99; 224/186, 202, 257

[56] References Cited

U.S. PATENT DOCUMENTS

| | | | |
|---|---|---|---|
| 1,526,839 | 2/1925 | Dempsey | 190/26 |
| 2,520,250 | 8/1950 | Meyers | 190/26 X |
| 2,724,467 | 11/1955 | Jaffe | 190/26 |
| 3,901,360 | 8/1975 | Cook | 190/26 |
| 4,335,891 | 6/1982 | Alley et al. | 224/921 X |
| 4,590,714 | 5/1986 | Walker | 52/3 |
| 4,674,787 | 6/1987 | DeVera | 150/154 X |
| 4,682,447 | 7/1987 | Osborn | 52/3 |
| 4,953,674 | 9/1990 | Landes | 190/26 X |
| 5,083,644 | 1/1992 | Collins III | 190/26 |
| 5,148,956 | 9/1992 | Funk | 224/214 X |

FOREIGN PATENT DOCUMENTS

| | | | |
|---|---|---|---|
| 548626 | 3/1922 | France | 190/26 |

*Primary Examiner*—Allan N. Shoap
*Assistant Examiner*—Christopher McDonald
*Attorney, Agent, or Firm*—Frank J. Dykas; Craig M. Korfanta; Ken J. Pedersen

[57] ABSTRACT

Embodiments of a removable luggage cover are disclosed, each for protecting a piece of luggage from damaging and dirty environments. The luggage cover is a piece of durably woven fabric held on the luggage either by being directly attached to the luggage with clips or buckles or by enveloping the luggage and being clipped or buckled together. No zipper for an envelope nearly completely enclosing the luggage is required. The luggage cover allows access and use of the luggage handle while the cover is in place, and is adjustable to luggage of different sizes and shapes.

1 Claim, 3 Drawing Sheets

REMOVABLE LUGGAGE COVER

BACKGROUND OF THE INVENTION

1. Technical Field.

This invention relates generally to luggage and luggage accessories. More specifically, this invention is a removable protective cover for luggage and a way of protecting luggage from damaging and dirty environments.

2. Background Art.

Recent years have brought a proliferation of luggage types, styles, materials, and designs. The purchase of luggage frequently requires a significant investment, due to expensive materials and intricate construction. Luggage that meets the traveler's needs for lightweight construction, organized and compartmentalized packing, or distinctive and decorative appearance often does not hold up well to the damaging and dirty environment of commercial transportation and lodging. Garment bags and other soft-sided luggage are often caught, snagged, or torn by automatic baggage-handling equipment. Many outside luggage compartments and pouches are not designed for secure closure and can allow items to easily fall out or be removed by a thief. Garment bags are ungainly for placement in overhead bins or under seats. Many garment bags are ungainly to carry and set down, even when in the folded position, because of their shapeless and flexible form. Aluminum and leather suitcases are often scratched or scuffed. Leather and designer fabrics are easily soiled. Therefore, there is a need for a way to protect luggage from commercial transportation and lodging damage with a cover that is removable and relatively inexpensive compared to the cost of the luggage.

DISCLOSURE OF INVENTION

Applicant's invention is a way of protecting luggage from scrapes, scratches, snags, tears, and dirt. It involves a removable, cleanable, and inexpensively replaceable cover. The luggage cover takes the brunt of the rough treatment in commercial transportation and lodging, and therefore preserves and extends the life of the expensive luggage it covers. The luggage cover shields the outside pouches and compartments of luggage, making it more difficult for items to fall out or for thieves to quickly take items out of the luggage.

The luggage cover is a fabric member which circumvolves a piece of luggage and is removably secured to the luggage. The cover can be secured to the luggage by being attached directly to the luggage. Alternatively, the cover can be secured by virtue of it enveloping and surrounding enough of the luggage that it cannot come off except by reopening the opening through which the luggage was originally inserted. The luggage handle is reachable and usable through the partially open insertion-hole or through a separate handle-hole which is large enough for the handle but not large enough for the luggage to come through. An anchor-means may be used to tie or hook the cover to the luggage or through the luggage handle to keep the cover from shifting in position.

The luggage cover can be used to disguise a very expensive piece of luggage while in poor security airports or baggage check rooms to reduce the chance of its being stolen. The luggage cover can be decorated or labeled with indicia to provide a change of appearance for old luggage or to provide quick sighting and identification of a piece of luggage in a crowded environment. Travel companies or other companies can mark the cover with indicia to advertise their tour or services or to make all the bags on a tour look alike.

The luggage cover can be made in different sizes or can be made to adjust to various sizes and shapes of luggage. The cover can be light weight and foldable for stashing in a small space.

BEST MODE FOR CARRYING OUT INVENTION

Figure 1:
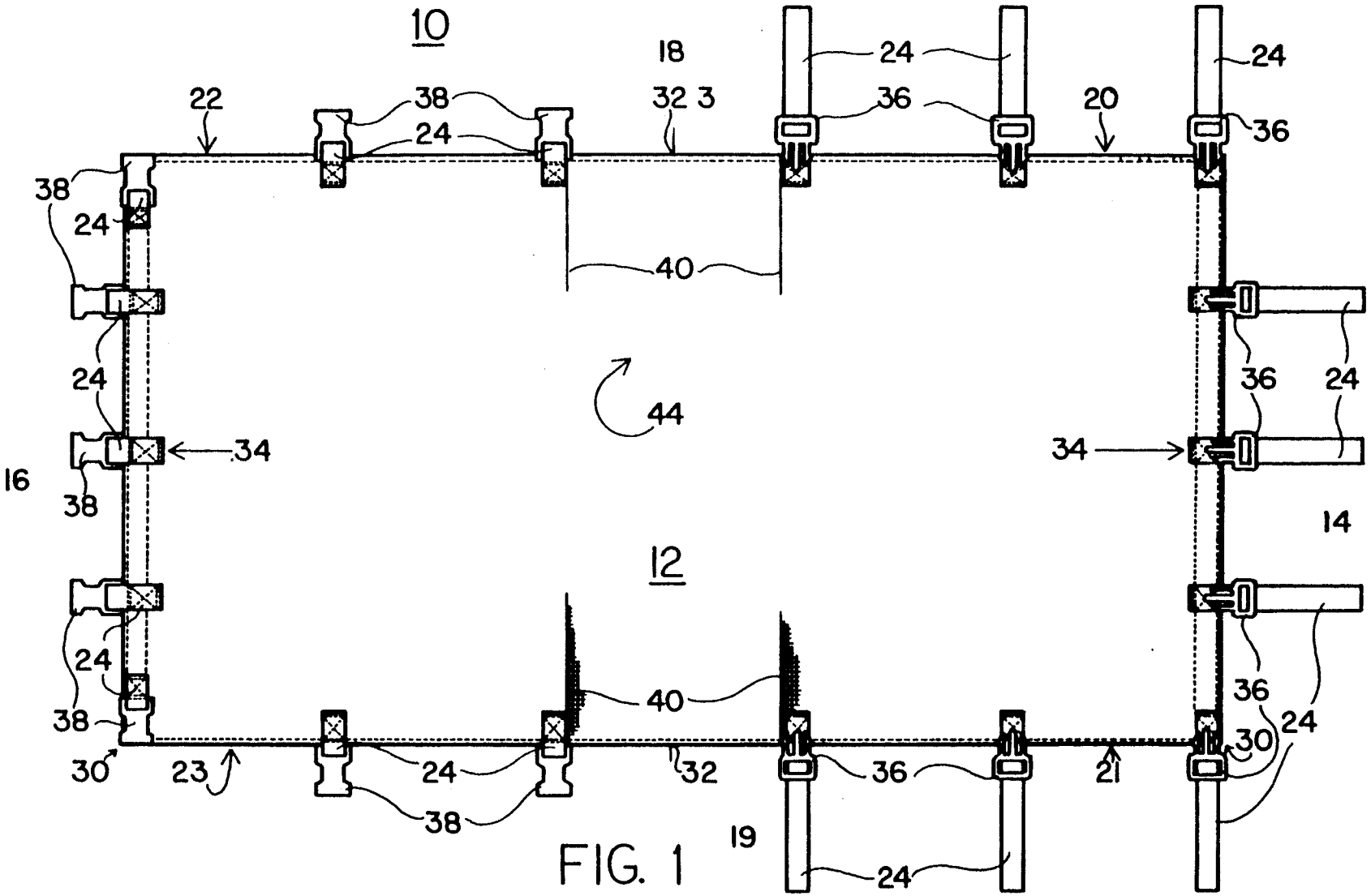
FIG. 1 is a perspective view of an embodiment of the invented luggage cover as it appears when detached from any luggage and spread out flat.

Referring to the Figures, there is generally depicted an embodiment of the invented luggage cover (10). The preferred embodiment is a generally rectangular woven, one-piece, substantially planar fabric sheet (12) with dimensions of about 30 inches by 55 inches. Optionally, the sheet (12) may be larger or smaller to fit a wide range of luggage sizes. The sheet (12) has perimeter end edges (14 and 16) and side edges (18 and 19), and the side edges (18 and 19) each have a right half (20 and 21) and a left half (22 and 23).

Webbing straps (24) are attached to the sheet (12) at approximately equal intervals along the end edges (14 and 16) and at approximately equal intervals along the side edges (18 and 19). A set of three straps (24) is attached to each right half (20 and 21) and to each left half (22 and 23), so that one of the three straps (24) is close to the corner (30) of the sheet (12), one strap (24) is offset about 4.5 inches from the center (32) of the side edge (18 and 19), and one strap (24) is approximately equidistant between the corner (30) and the center (32) of the side edge (18 and 19). A set of three straps (24) is attached to each end edge (14 and 16), with two of the three straps positioned about 7 inches in from the corners (30) and the third strap near the center (34) of the end edge (14 and 16).

Male side-release buckles (36) are attached to the webbing straps (24) on the right half (20 and 21) of the side edges (18 and 19) and on one end edge (14). Cooperating female buckles (38) are attached to the webbing straps (24) on the left half (22 and 23) of the side edges (18 and 19) and on one end edge (16). The length of the straps (24) with the male buckles (36) can be adjustably lengthened or shortened in a range of preferably, but not limited to, 1 to 10 inches. The straps (24) with the female buckles (38) are approximately, but not limited to, 1 inch long.

Optionally, there may be more or fewer straps (24) and buckles (36 and 38) and they may be differently positioned than above, and the intervals between the straps (24) on the side edges (18 and 19) may be different from the intervals between the straps (24) on the end edges (14 and 16). Optionally, the straps (24) and the buckles (36 and 38) may be replaced by any detachable fastener or latch. The critical aspect of the fasteners or latches and the positions thereof is that, when used to hold a sheet (12) around a piece of luggage (50 and 60), the cover (10) envelopes the luggage (50 and 60) to an extent preventing the luggage from coming out of the cover (10) until the fasteners or latches are reopened. Snaps, clips or clasps may also be used to secure the cover to the luggage. No zipper for an envelope nearly completely enclosing the luggage is required.

The preferred embodiment has optional tucks (40) gathered and sewn in the fabric sheet (12) at about 4.5 inches from the center (32) of each side edge (18 and 19), which help the sheet (12) to fit and conform to the rectangular bottom (62) of a suitcase (60).

Figure 2:
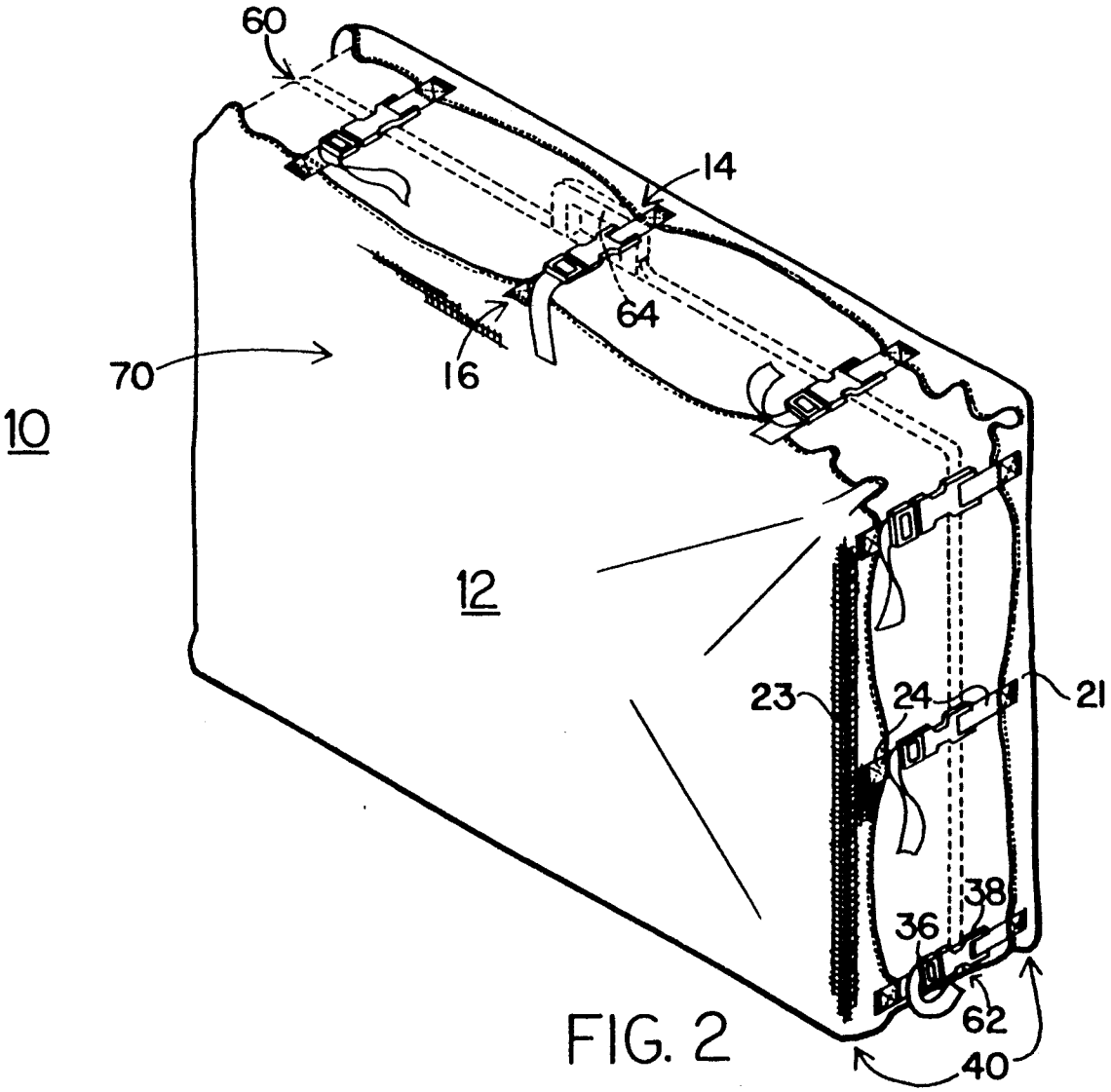
FIG. 2 is a perspective view of an embodiment of the luggage cover in combination with a folded garment bag.
Figure 3:
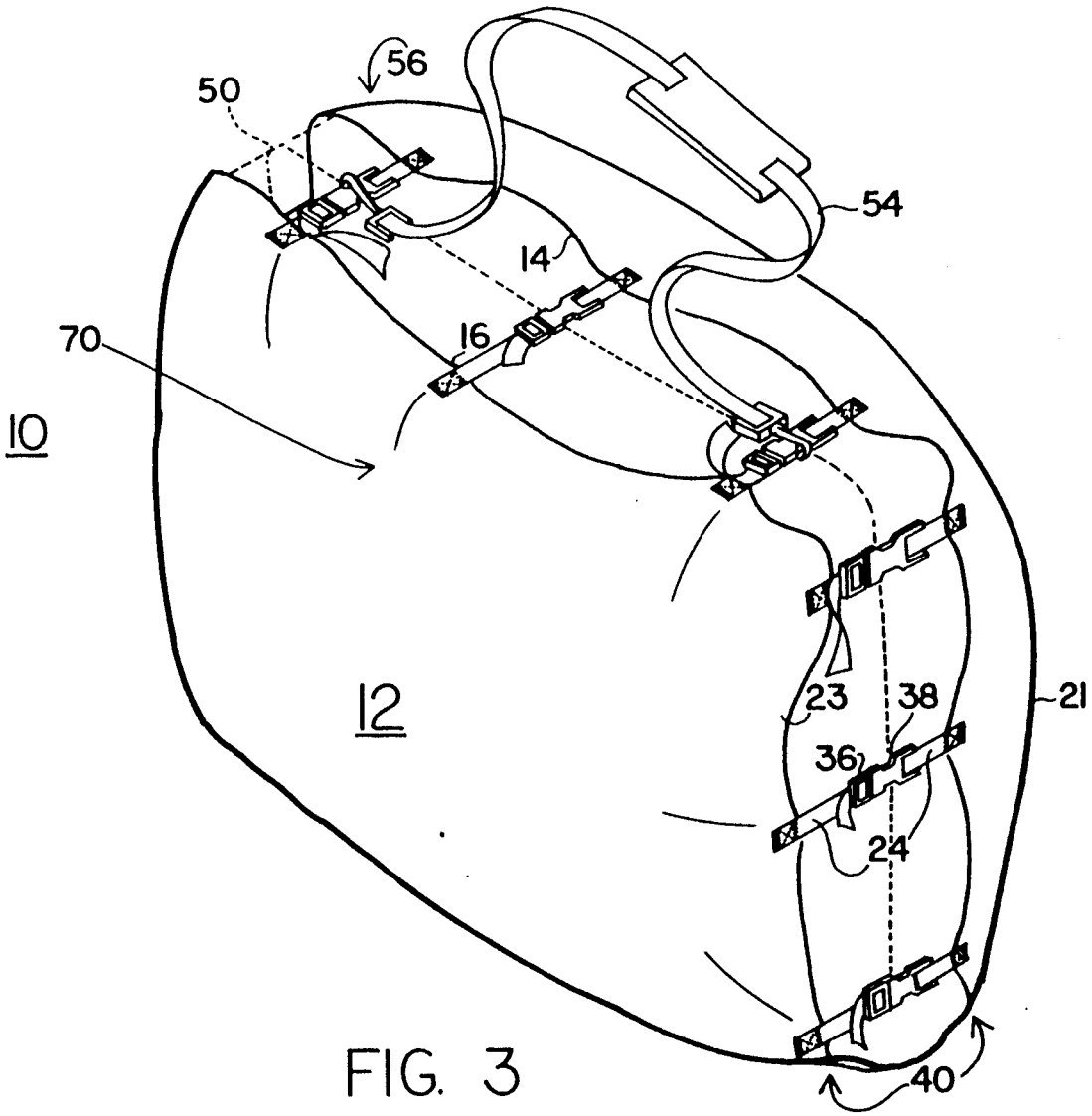
FIG. 3 is a perspective view of an embodiment of the luggage cover in combination with a hard-sided suitcase.

The preferred embodiment is shown in combination with a garment bag (50) in FIG. 3 and a hard-sided suitcase (60) in FIG. 2. The cover (10) is put in place by wrapping the sheet (12) around the luggage (50 and 60) in a U-shape, so that the right half (20) and left (22) of side edge (18) are close to each other, the right half (21) and left half (23) of the other side edge (19) are close to each other, and the two end edges (14 and 16) are close to each other. The area (44) of the sheet (12) defined by the four tucks (40) is placed at the side (52 and 62) of the luggage (50 and 60) that best fits the area (44), provided that this places the luggage handle (54 and 64) in a position to come through a gap (56 and 66) between the sheet edges (14, 16, 18, 19).

To secure the sheet (12) to the luggage (50 and 60), the male buckles (36) and female buckles (38) are connected and the webbing straps (24) are lengthened or shortened to give a snug fit of the cover (10) on the luggage (50 and 60). The strap or straps (24) closest to the handle (54 and 64) are connected through the handle to aid in keeping the fabric sheet (12) in place. The cover (10) may be quickly removed by unlatching the buckles (36 and 38).

The fabric sheet (12) is preferably, but not limited to, a woven fabric that is lightweight, water resistant, and washable or otherwise cleanable. The fabric may be a layered composition with a waterproof and/or stain resistant lining or treatment. A fabric such as Cordura TM is one option. The straps (24) and buckles (36 and 38) or alternative latches or anchors used to hold the cover (10) onto the luggage (50 and 60) are preferably washable or cleanable along with the fabric sheet (12). The cover (10) preferably is sewn or constructed by a means that allows washing or cleaning without damage.

Optionally, indicia, decoration or advertising (70) may be printed, embroidered, or otherwise attached to the fabric sheet (12). Preferably, the indicia and decoration are also washable or cleanable.

While there is shown and described the present preferred embodiment of the invention, it is to be distinctly understood that this invention is not limited thereto but may be variously embodied to practice within the scope of the following claims.

I claim:

1. A removable luggage cover consisting of:

a rectangular, one-piece, substantially planar fabric sheet having two opposing end edges and two opposing side edges, the side edges each having a left half and a right half, said sheet having tucks gathered and sewn in it near the center of each side edge so that the cover fits and conforms to a piece of luggage;

a plurality of straps attached to the sheet at approximately equal intervals along the end edges, and at approximately equal intervals along the side edges; and cooperating latch means adjustably attached to each strap so that straps at opposing end edges may be detachably engaged together, and straps at the left half of the side edges may be detachably engaged to straps at the right half of the same side edge.

* * * * *